United States Patent [19]

Akiyama et al.

[11] 4,091,515

[45] May 30, 1978

[54] APPARATUS FOR MOUNTING A CONNECTOR TO COATED WIRES

[75] Inventors: Yasutaka Akiyama, Tachikawa; Yoshio Iijima, Hiratsuka, both of Japan

[73] Assignees: Sumitomo Electric Industries, Ltd., Osaka; Japan Aviation Electronics Industries Ltd., Tokyo, both of Japan

[21] Appl. No.: 797,749

[22] Filed: May 17, 1977

[30] Foreign Application Priority Data

| | | |
|---|---|---|
| May 20, 1976 | Japan | 51-58734 |
| May 20, 1976 | Japan | 51-58735 |
| May 20, 1976 | Japan | 51-58736 |
| May 10, 1976 | Japan | 51-52642 |

[51] Int. Cl.[2] ..... B21B 15/00

[52] U.S. Cl. ..... 29/33 M

[58] Field of Search ..... 29/33 M, 566.1, 566.2, 29/566.3

[56] References Cited

U.S. PATENT DOCUMENTS

| | | | |
|---|---|---|---|
| 2,998,633 | 9/1961 | Andren | 29/33 M |
| 3,867,754 | 2/1975 | Koch et al. | 29/566.2 |
| 3,869,781 | 3/1975 | Eubanks et al. | 29/33 M |
| 3,964,142 | 6/1976 | Ogawa | 29/33 M |
| 4,041,589 | 8/1977 | Lugger | 29/33 M |

*Primary Examiner*—Harrison L. Hinson

*Attorney, Agent, or Firm*—Hammond & Littell

[57] ABSTRACT

Discloses a novel automatic apparatus for mounting a connector to coated wires. The apparatus comprises means for cutting a coated wire to a predetermined length, means for removing the coating of the wire to a predetermined length from its cut end to expose the conductor therein, means for mounting an electric terminal for the connector to the exposed conductor and means for inserting the terminal mounted to the exposed conductor into one of openings provided in an insulator for the connector.

10 Claims, 16 Drawing Figures

FIG. 7
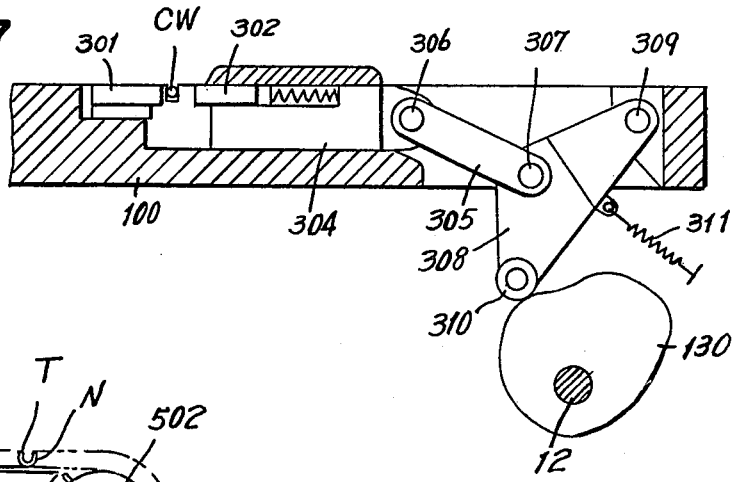
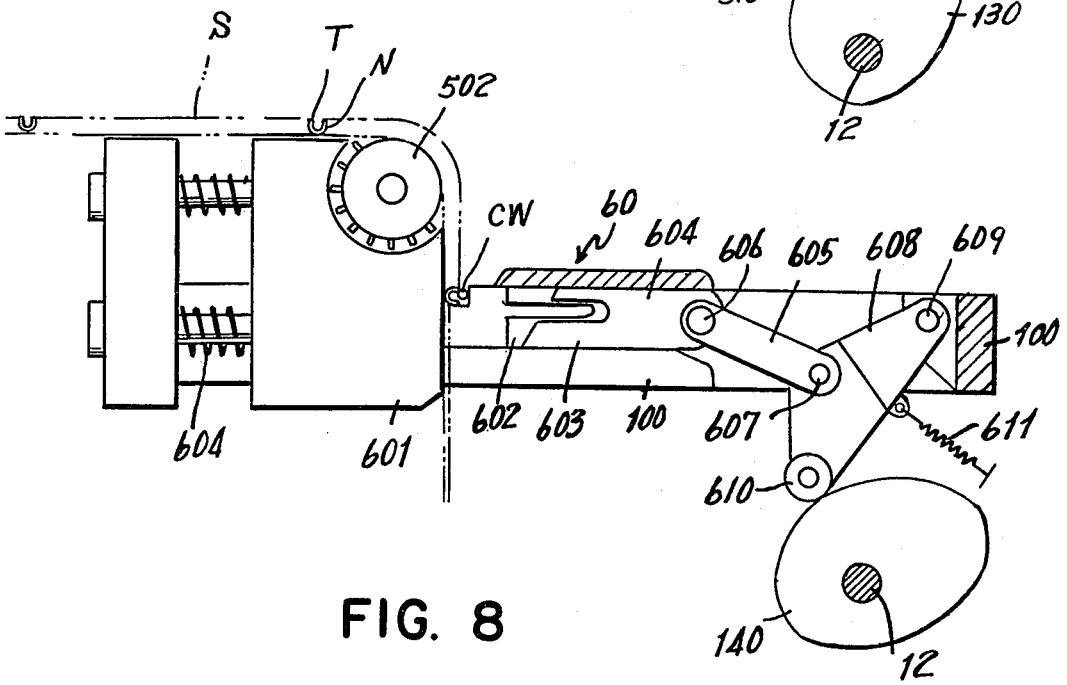
FIG. 8

FIG. 9
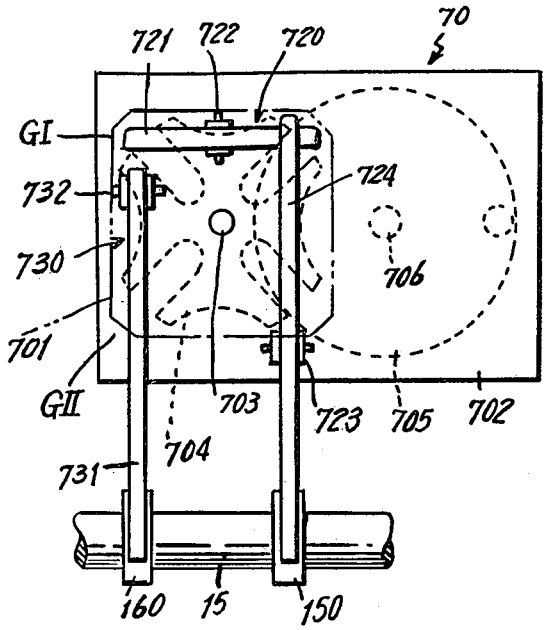
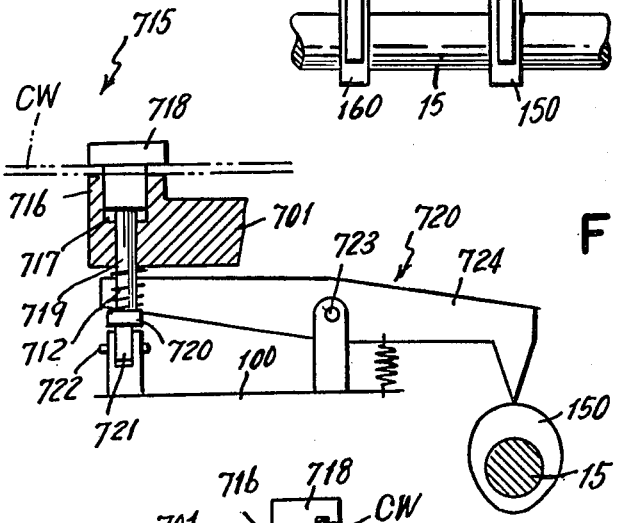
FIG. 10
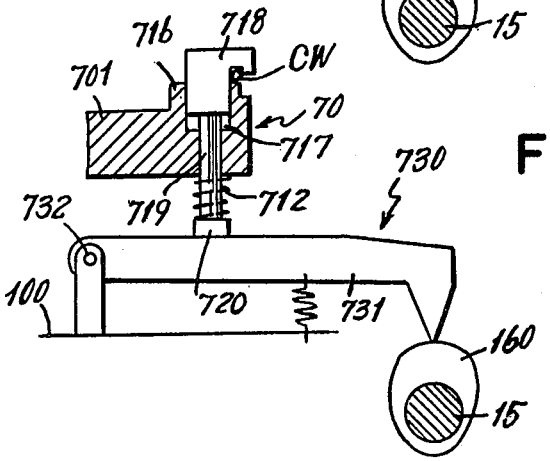
FIG. 11

APPARATUS FOR MOUNTING A CONNECTOR TO COATED WIRES

BACKGROUND OF THE INVENTION

This invention relates to automatic apparatuses for mounting terminals to coated wires and inserting the terminals into a connector, and it particularly relates to an automatic connector-mounting apparatus for mounting a multipolar connector to a coated wire group consisting of a plurality of coated wires.

Heretofore, in mounting a multipolar connector to the ends of a coated wire group consisting of a plurality of coated wires, initially one of the coated wires has been taken out of the group, the end thereof has been cut to a predetermined length using a suitable tool such as a nipper, then the wire end has been stripped to expose the core conductor to a length required to mount an electric terminal thereto using a tool such as a wire stripper, an electric terminal has been mounted to the exposed conductor portion by any desired means, for example, by pressing, and finally the terminal has been inserted into an opening in a desired position selected from a plurality of openings provided in an insulator for the connector. These works have been manually accomplished. It is needless to say that such manual works are very troublesome and require a great deal of technical skill. Particularly, in mounting a multipolar connector to a plurality of coated wires such as used in communication cables, electron computers, measuring apparatuses, etc., a considerable time and labor have been required inefficiently.

OBJECTS OF THE INVENTION

In view of the above, the primary object of the present invention is to provide an automatic connector-mounting apparatus which automatically mounts electric terminals to exposed conductor ends of a coated wire group consisting of a plurality of coated wires and inserts the mounted terminals into openings provided in an insulator of a multipolar connector.

Another object of the present invention is to provide an apparatus which is capable of automatically and accurately accomplishing the steps of cutting each individual wire of a coated wire group consisting of a plurality of coated wires to a predetermined length, stripping the wire over a predetermined length from the end thereof to expose its core conductor, pressing an electric terminal to the exposed conductor end and inserting the terminal into a predetermined opening in an insulator of the connector having a plurality of openings.

A further object of the present invention is to provide an apparatus for automatically mounting the above-mentioned coated wires to an connector, which is very simple to operate.

DESCRIPTION OF DRAWINGS

Now the present invention will be described in detail with reference to the accompanying drawings, wherein FIG. 7 is a section taken along line VII — VII of FIG. 3 to illustrate means for cutting coated wires in the apparatus of the present invention, FIG. 8 is a section taken along line VIII — VIII of FIG. 3, FIGS. 9, 10 and 11 are schematic diagrams to be used to describe means for guiding a terminal-attached wire in the apparatus of the present invention.

DETAILED DESCRIPTION OF A PREFERRED EMBODIMENT

The present invention will first be described with reference to FIGS. 1 and 2 to generally understand the invention.

Figure 1:
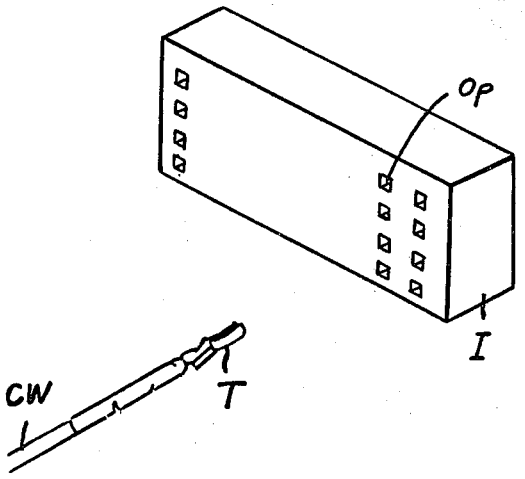
FIG. 1 is a schematic perspective diagram showing a wire with an electric connector provided by the apparatus of the present invention.

FIG. 1 is a schematic perspective view showing that by the use of the apparatus of the present invention, an electric terminal T may be mounted to the exposed conductor end of a coated wire picked up from a bundle consisting of a plurality of coated wires CW and the terminals may be successively inserted into predetermined openings OP provided in an insulator I of a multipolar connector whereby coated wires with an electric connector may be provided.

Figure 2:
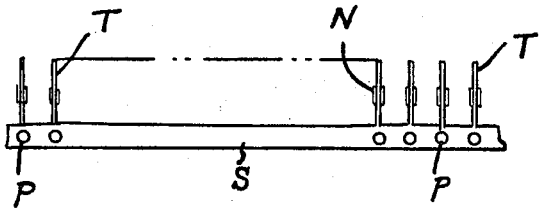
FIG. 2 is a plan diagram showing a part of an electric terminal carrier used in the apparatus of the present invention.

FIG. 2 is a schematic plan view of a portion of a band electric terminal carrier S supporting in a comblike manner a plurality of electric terminals T to be respectively mounted to the ends of exposed core conductors of coated wires by using the apparatus of the present invention and have perforations P of a predetermined pitch.

Figure 3:
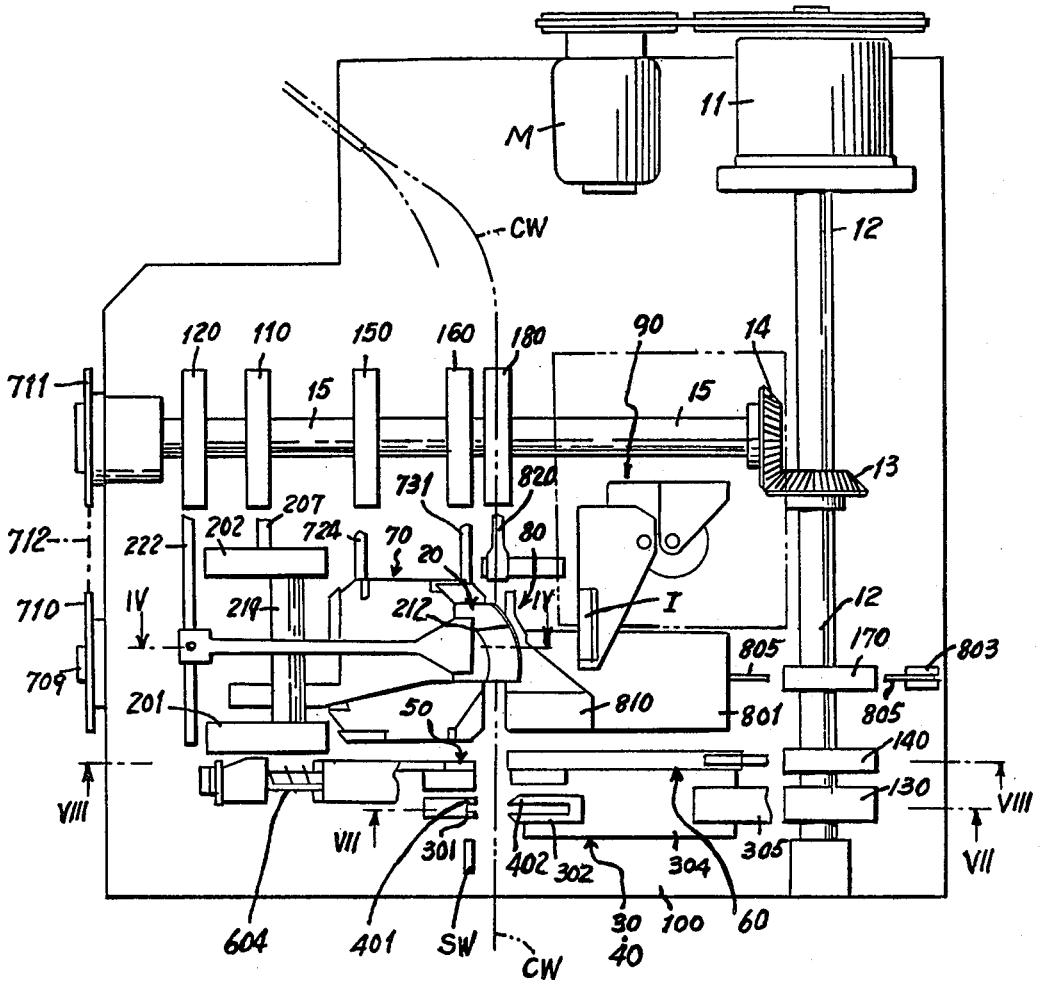
FIG. 3 is a plan view to be used to describe the relationship between the essential components of the automatic connector-mounting apparatus of the present invention.

FIG. 3 is a partially omitted plan to be used to describe the relationship between the essential components in the automatic connector-mounting apparatus of the present invention. Referring to FIG. 3, the automatic connector-mounting apparatus 10 is provided with a motor M and an one-turn clutch 11 as its driving system. The output shaft of the motor M is coupled to the input shaft of the one-turn clutch 11 through a suitable transmission mechanism and the one-turn clutch 11 is capable of making its output driving shaft 12 one turn everytime it is electrically energized. The driving shaft 12 is provided with a second driving shaft 15 which is rotatable with the driving shaft 12 through bevel gears 13, 14. The essential components of the apparatus 10 of the present invention are controlled by the rotation of these first and second driving shafts 12, 15.

The connector mounting apparatus 10 further comprises means 20 for gripping a part of the free end of each coated wire CW, a limit switch SW for energizing the one-turn clutch 11 which is electrically actuated to start the desired operation after a coated wire CW has been inserted into a predetermined position in the apparatus 10, means 30 for cutting the free end of the particular coated wire CW to a predetermined length, means 40 for stripping the coated wire to a predetermined length from the cut end of the wire to expose the core conductor, means 50 for feeding to the exposed conductor portion of the wire an electric terminal T on the electric terminal carrier S which supports a plurality of such terminals in a comblike manner and has perforations P of a predetermined pitch, means 60 for pressing the electric terminal T to the exposed conductor portion of the wire and severing the terminal from the carrier S, means 70 for guiding the terminal T pressed to the coated wire CW to the front of the insulator I for the multipolar connector, means 80 for inserting the terminal pressed to the exposed conductor part of the coated wire into a predetermined opening OP in the insulator I, and means 90 for supporting the insulator of the multipolar connector and successively positioning the openings OP in the terminal inserting position.

Now the essential components of the connector-mounting apparatus 10 of the present invention will be described in details.

(Wire gripping means 20)

Figure 4:
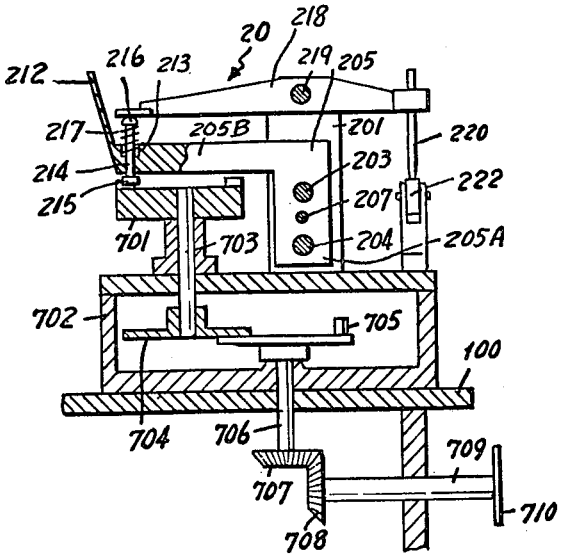
FIG. 4 is a sectional view taken along line IV — IV of FIG. 3.

The means 20 for gripping the coated wire CW will be described in detail with reference to FIGS. 4 - 6. The wire gripping means 20 includes strut members 201, 202 in spaced relation to each other and secured to suitable parts of a frame 100 for the connector mounting apparatus. The strut members 201, 202 are respectively provided with bar members 203, 204 secured thereto in longitudinally spaced relation. An L-shaped member 205 is mounted to these bar members so as to be slidable. More particularly, one arm 205A of the L-shaped member 205 is provided with holes to receive the bar members 203, 204 which are wound respectively with coiled springs 206 situated between the bar members and the strut member 202. The arm 205A of the L-shaped member 205 can be slided in the axial direction of the bar members 203, 204 with the rotation of a cam 110 mounted to the second driving shaft 15 through suitable lever members such as 207, 208 and 209.

The end of the other arm 205B of the L-shaped member 205 is fixedly secured to a guide member 212 which serves to guide coated wires CW. This guide member 212 is formed of an arcuate downwardly convergent plate. The arm 205B of the L-shaped member 205 is provided with an opening 213 adjacent to the guide member 212, and a short shaft 214 is extended in this opening 213 so as to be longitudinally movable. The shaft 214 has a block 215 at its lower end. The shaft 214 also has a head 216 and is wound with a coiled spring 217 disposed between the head 216 and the arm 205B and the top face of the block 215 is contacted with the bottom face of the arm 205B.

The top of the head 216 of the shaft 214 is contacted with one end of a lever 218 which is mounted to the strut members 201, 202 through a shaft 219 so as to be rockable. The other end of the lever 218 is communicated through a suitable transmission mechanism 220, 222 with a cam 120 mounted to the second driving shaft 15.

As will be described hereinlater, upon the actuation of the switch SW, during one turn of the second driving shaft 15 due to the one-turn clutch 11, the lever 218 rocks about the shaft 219 and its free end presses the head 216 of the shaft 214 to push down the shaft 214 against the resilience of the coiled spring 217. Thus the top face of the block 215 is separated from the bottom face of the arm 205B leaving therebetween a space into which coated wire CW guided along the outer surface of the guide member 212 is inserted. The coated wire thus inserted into the space is gripped in between the block 215 and the arm 205B as the cam 120 is turned.

(Wire Cutting Means 30 and Conductor Exposing Means 40)

Referring to FIGS. 3 and 7, the wire cutting means 30 and the conductor exposing means 40 include a cutting edge 301 fixed to the frame 100 and a stripper cutting edge 401 also fixed to the frame 100 in a position adjacent to the cutting edge 301 to strip the coated wire by a predetermined length from the cut end thereof. A movable cutting edge 302 and a movable stripper cutting edge 402 are provided so as to be movable relative to the fixed cutting edge 301 and the fixed stripper cutting edge 401 respectively. For this purpose, the movable cutting edges 302 and 402 are formed integrally and are supported at the front end of a horizontally slidable member 304 which is slidable relative to the frame 100. One end of an arm 305 is pivotally connected to the rear end of the slidable member 304 by a pin 306 while the other end of the arm 305 is pivotally connected to a cam follower-mounting member 308 by a pin 307. One end of the cam follower-mounting member 308 is pivotally connected to the frame 100 by a pin 309 and a cam follower 310 is mounted to the other end of the member 308. The cam follower-mounting member 308 is arranged so that by means of a spring 311, the cam follower 310 is brought into contact with a cam 130 mounted to the first driving shaft 12.

When the one-turn clutch 11 is energized, the first driving shaft 12 is revolved by one turn with the cam 130 whereby the slidable member 304 including the movable cutting edges is reciprocated. Thus the coated wire CW inserted in the space between the fixed cutting edge 301 and the movable cutting edge 302 is severed. At the same time, the stripper cutting edges 401 and 402 thrust into the coating of the coated wire without attaining to the conductor therein in a position spaced from the cut end of the coated wire.

Figure 5:
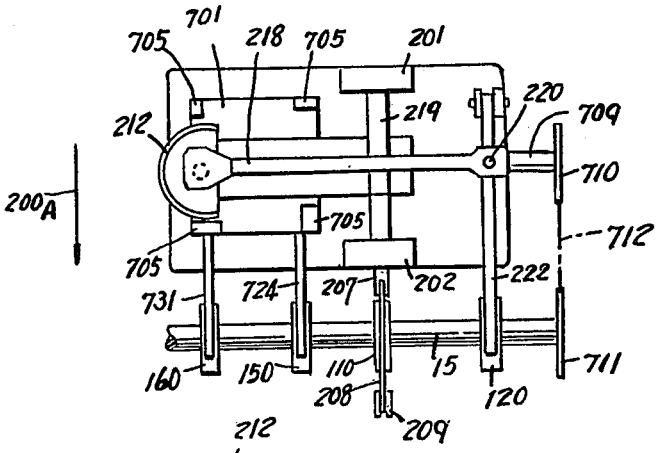
FIG. 5 is a plan view of wire gripping means in the apparatus of the present invention.
Figure 6:
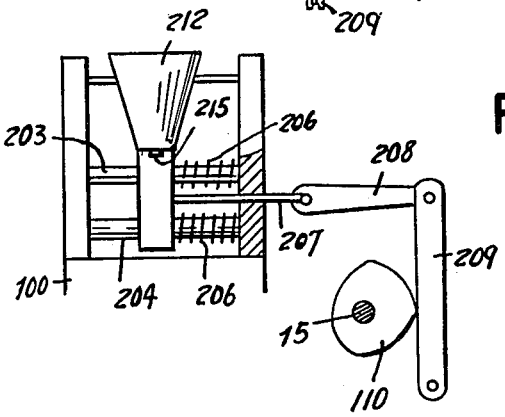
FIG. 6 is a schematic diagram of the mechanism for driving the wire gripping means.

At this time, the L-shaped member 205 of the gripping means 20 is slided by a predetermined distance in the direction indicated by an arrow 200A in FIGS. 5 and 6, due to the rotation of the cam 110 mounted to the second driving shaft 15. Thus the coated wire CW gripped in between the arm 205B of the arm member 205 in the gripping means 20 and the block 215 of the shaft 214 and having a coating portion into which the stripper cutting edges 401, 402 being thrusted at the cut end, is pulled in the direction shown by the arrow 200A as the gripping means 20 is retreated in the same direction leaving the coating portion into which the stripper cutting edges being thrusted in between the stripper cutting edges 401 and 402. In this manner, the coated wire is stripped to a predetermined length from the coating portion into which the cutting edges 401 and 402 being thrusted to the cut end and therefore, the core conductor may be exposed.

(Terminal-Feeding Means 50)

The electric terminal carrier S supporting thereon a plurality of electric terminals in comblike manner and having perforations of a predetermined pitch is extended over a sprocket wheel 502 arranged adjacent to the terminal pressing and severing means 60 from a spool (not shown) mounted to the novel automatic connector mounting apparatus 10 so that terminals T are fed successively to a predetermined position in. The terminal pressing means 60 with the rotation of the sprocket wheel 502, as shown in FIG. 8.

(Terminal Pressing and Severing Means 60)

As shown in FIG. 8, the means 60 for pressing the nails N of an electric terminal T to the exposed conductor portion of coated wire CW fed with the carrier S and severing the terminal from the carrier S comprises a die 601, a punch 602 and a cutter member 603. Preferably the die 601 is mounted to be stationary relative to the frame 100 or to be diametrically movable relative to the passage of coated wire CW. The punch 602 cooperates with the die 601 to press the nails N of a terminal T to the exposed conductor of coated wire CW presented therebetween so as to mount the terminal to the wire, while the cutter member 603 serves to sever the terminal T mounted to the exposed conductor of the wire from the carrier S.

The punch 602 and the cutter member 603 are supported at the front end of a horizontally slidable member 604 which is slidable relative to the frame 100. One end of an arm 605 is pivotally connected to the rear end of the slidable member 604 by means of a pin 606, and the other end of the arm 605 is in turn pivotally connected to a cam follower mounting member 608 by means of a pin 607. One end of the cam follower-mounting member 608 is pivotally connected to the frame 100 by means of a pin 609 and a cam follower 610 is mounted to the other end of the member 608. This cam follower-mounting member 608 is biased by a spring 611 so that the cam follower 610 comes into contact with a cam 140 mounted to the first driving shaft 12.

During one turn of the first driving shaft 12, the slidable member 604 is moved together with the punch 602 and the cutter member 603 toward the die 601 as the cam 140 is turned, so that the terminal pressing and severing means 60 presses the nails N of an electric terminal T to the stripped conductor of coated wire CW inserted in between the die 601 and the cutter member 603, then the terminal T pressed to the conductor of the coated wire is severed from the carrier 5 by the cutter member 603, thereafter the slidable member 604 is retreated from the die 601 to free the terminal T mounted to the coated wire CW from the terminal pressing and severing means 60.

When the terminal T is pressed to the exposed conductor of the coated wire CW by this terminal pressing means 60, the wire gripping means 20 releases the coated wire gripped till then. At the same time, terminal-mounted wire guiding means which will be described, is attached.

(Terminal-Mounted Wire Guiding Means 70)

The terminal-mounted wire guiding means 70 serves to turn the electric terminal T pressed to the exposed conductor of the coated wire by an angle of 90 degrees from the position of the terminal pressing and severing means 60 and to guide it to the front of means 90 to which an insulator for a multipolar connector is mounted.

As shown in FIG. 9, this guiding means 70 comprises a square index table 701. The table 701 is supported in such a manner that it may be turned with a shaft 703 journalled in a gear box 702. In the gear box 702, the shaft 703 is communicated with a shaft 706 through suitable motion transmitters 704, 705. In turn, the shaft 706 is communicated with a shaft 709 through suitable transmitters, for example, bevel gears 707, 708 (see FIG. 4). This shaft 709 is driven by the second driving shaft 15 through suitable transmission mechanism comprising, for example, chain sprockets 710, 711 and a chain 712 (see FIGS. 3 and 5).

In order to turn the table 701 with the shaft 703 by 1/4 turn, i.e. 90°, per revolution of the second driving shaft 15, preferably the transmitters 704, 705 are suitable intermittent movement devices such as Geneva gears. Each corner of the square index table 701 is provided with a clamp 715 for holding a portion of coated wire CW. As shown in FIGS. 10 and 11, each of these clamps 715 comprises a projected portion 716 formed at the corner of the table 701, a pin 719 having a clamp head 718 inserted into an opening 717 extending through the projected portion 716 and the table 701, and a coiled spring 712 would round the pin 719 between a block 720 at the lower end of the pin 719 and the bottom surface of the table in order to bias the clamp head 718 so as to bring it always in contact with the top surface of the projected portion 716 of the table.

The clamp 715 cooperates with means 720, 730 for actuating the clamp 715 to hold or release coated wire CW in the first position GI thereof adjacent to the terminal pressing and severing means 60 and in the second position GII in which the clamp 715 which had been in the first position is stopped upon turning the table 701 by 90°.

In the first position GI of the clamp 715, a portion of the coated wire CW is held in between the projected portion 716 of the table 701 and the clamp head 718. For this purpose, the clamp actuating means 720 includes a lever 721 as shown in FIG. 10. The lever 721 is pivotally connected to the frame 100 by a pivot 722 and one end thereof is terminated in a position in which it contacts with the bottom surface of the block 720 of the pin 719 extending through the table 701. The other end of the lever 721 is contacted with one end of a lever 724 pivotally connected to the frame 100 by a pivot 723 so as to be orthogonal to the lever 721, while the other end of the lever 724 is contacted with a cam 150 mounted to the second driving shaft 15 so as to be actuated thereby. Due to the profile configuration of this cam 150, during one revolution of the second driving shaft 15, the lever 724 is rocked about the pivot 723 whereby to rock the lever 721 about the pivot 722 and to push up the block 720 of the pin 719 of the clamp 715 from the free end of the lever 721 against the resilience of the coiled spring 712 so as to form a space between the projected portion 716 of the table 701 and the clamp head 718, into which space, a portion of the coated wire CW is inserted and the wire in the space is clamped as the cam 150 is turned. Then the table 701 is turned by 90° while the coated wire CW is held by the clamp 715 so that the clamp 715 holding the coated wire CW occupies the second position GII.

In the second position GII, the block 720 at the lower end of the pin 719 in the clamp 715 cooperates with an actuating means 730. The actuating means 730 includes a lever 731 of which one end is pivotally connected to the frame by a pivot 732 and of which free end is arranged in contact with a cam 160 mounted to the second driving shaft 15 so as to be rockable about the pivot 732 as the cam 160 is rotated. The top surface of the lever 731 is arranged in contact with the block 720 of the pin 719 of the clamp 715, thus as the lever 731 is rocked, it pushes up the pin 719 against the resilience of the coiled spring 712 so as to release the coated wire held by the clamp 715.

(Terminal Inserting Means 80)

Figure 12:
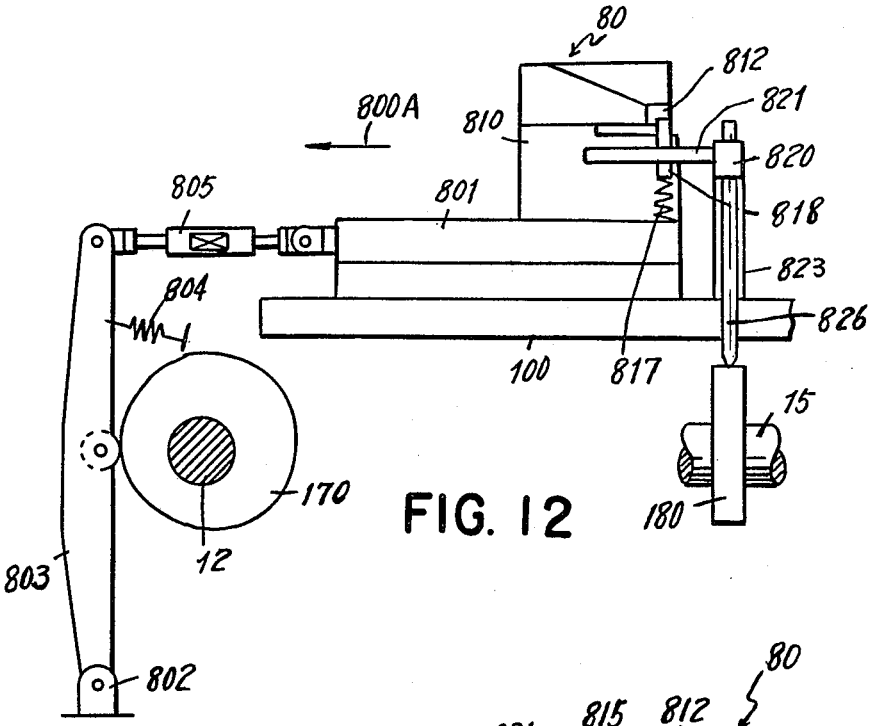
FIGS. 12 and 13 are side views to be used to describe means for inserting terminals in the apparatus of the present invention.
Figure 13:
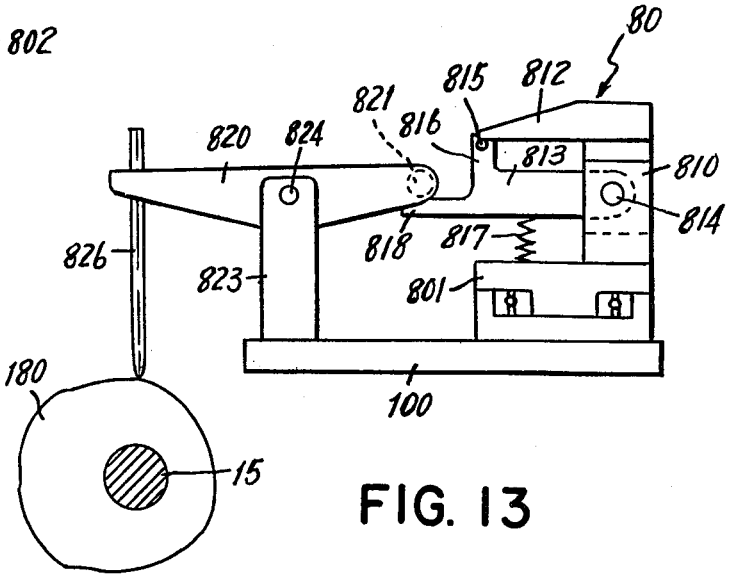

As shown in FIGS. 12 and 13, the terminal inserting means 80 has a base 801. The base 801 is mounted to the frame 100 so that it may be horizontally reciprocated in parallel with the axis of the second driving shaft 15.

Means for reciprocating the base 801 comprises a cam 170 mounted to the first driving shaft 12 so as to be rotatable with the shaft 12, a lever 803 having one end pivotally mounted to a portion of the frame 100 by a pivot 802, a spring 804 which is arranged to force the lever 803 into contact with the cam face of the cam 170 positively, and a connection rod 805 connecting the free end of the lever 80 to one end of the base 801.

A strut 810 is fixedly secured to the other end of the base 801. An upper clipper member 812 extending in parallel with the axis of the first driving shaft 12, is secured to the top end of the strut 810. Below the upper clipper member 812, a lower clipper member 813 is pivotally connected to the strut by a pivot or pin 814. The lower clipper member 813 is formed integrally therewith a receiver 816 having therein a groove 815 which receives a portion of the coated wire CW near the electric terminal T pressed to the exposed conductor of the wire in cooperation with the bottom surface of the tie end of the upper clipper member 812. A spring 817 is provided between the lower clipper member 813 and the base 801 to push up the lower clipper member 813 so as to force the receiver 816 in contact with the bottom surface of the upper clipper member 812.

The lower clipper member 813 has an extended portion 818 on which a cross bar 821 mounted to the free end of a lever 820 is laid. The lever 820 is pivotally connected to a strut 823 secured to the frame 100 at 824 and a cam follower 826 is mounted to the other end of the lever 820. The cam follower 826 is arranged in contact with the cam face of a cam 180 mounted to the second driving shaft 15, thus as the second driving shaft 15, therefore, the cam 180 thereon is rotated, the extended portion 818 of the lower clipper member 813 is pushed down through the cross bar 821 of the lever 820 against the resilience of the spring 817 to release the engagement between the tip end of the upper clipper member and the receiver 816 of the lower clipper member or the engagement therebetween may be maintained.

Since the terminal inserting means 80 is arranged as described hereinabove, until the terminal T pressed to the stripped conductor of the coated wire CW in the pressing means attains its second position GII from the first position GI by the rotation of the guiding means 70, the tip end of the upper clipper member 812 and the receiver 816 of the lower clipper member 813 in the terminal inserting means 80 are maintained in disengaged state, however, when the terminal T is moved to the second position GII by the guiding means 70, a portion of the coated wire CW near the terminal T is received in the groove 815 of the receiver 816, then as the cam 180 is turned, the terminal T may be maintained in the state in which it is held in between the tip end of the upper clipper member 812 and the receiver 816 of the lower clipper member 813.

At this time, due to the configuration of the cam 170 mounted to the first driving shaft, the base 801 of the guiding means 80 is moved in the direction shown by an arrow 800A in FIG. 12 to insert the terminal T held between the upper member 812 and the receiver 816 of the lower member 813 into one of the openings OP in the insulator I for the multipolar connector mounted to connector positioning means 90.

(Connector's Insulator Positioning Means 90)

Figure 14:
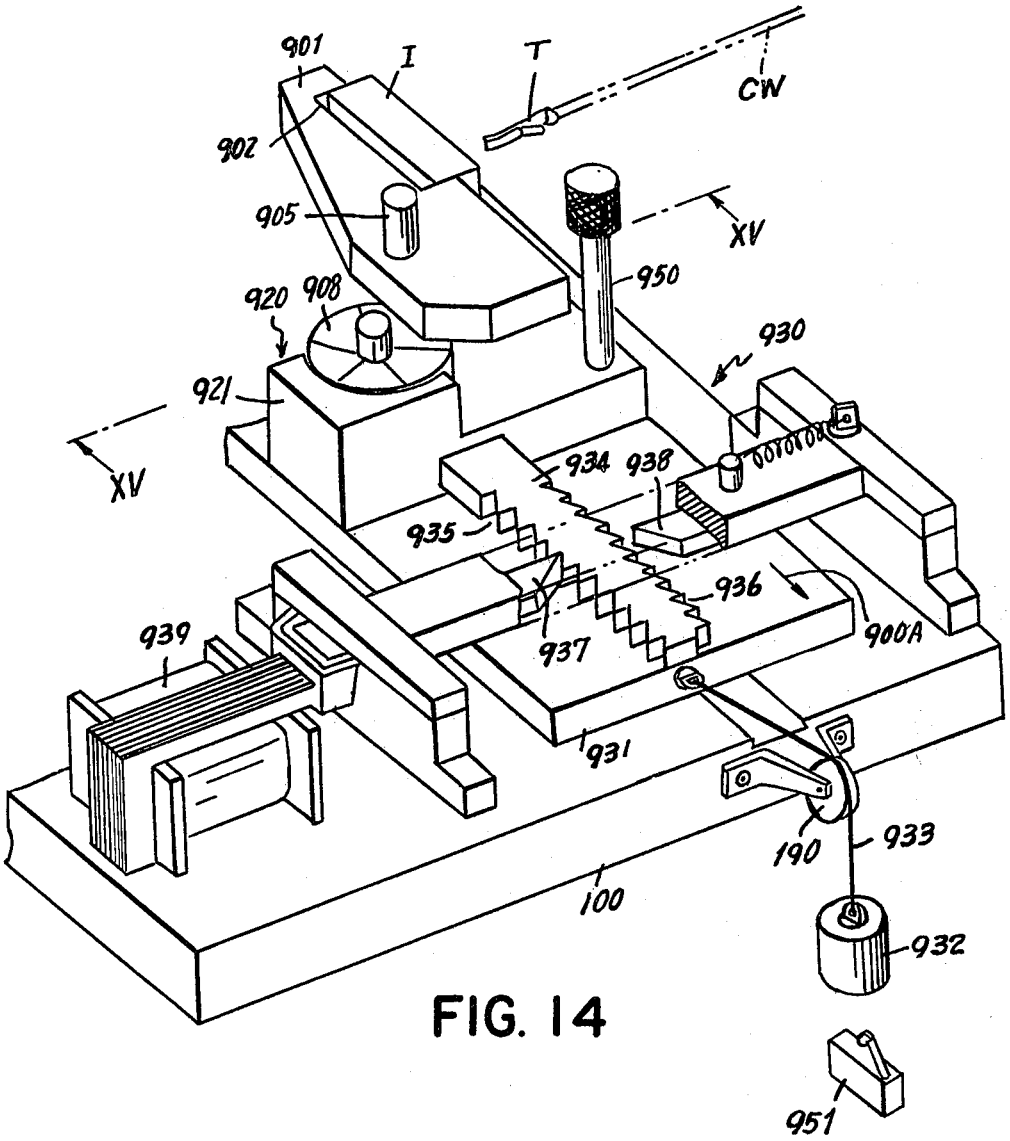
FIG. 14 is a perspective view of means for positioning an insulator for the connector in the apparatus of the present invention.
Figure 15:
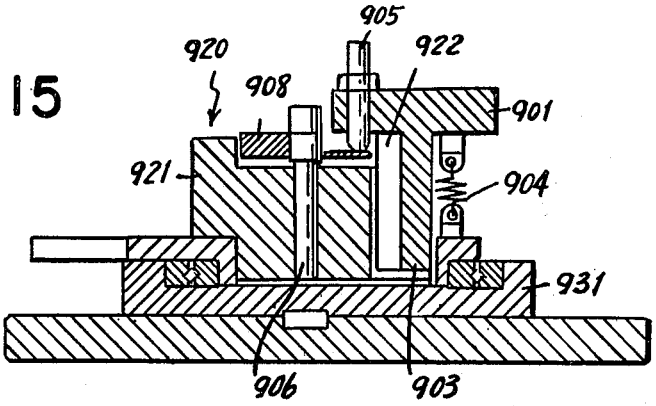
FIG. 15 is a section taken along line XV — XV of FIG. 14.

As shown in FIGS. 14 and 15, the connector's insulator positioning means 90 comprises a holding bed 901 for supporting the insulator I of an multipolar connector into which electric terminals T pressed to coated wires CW are inserted, means 920 for longitudinally positioning in succession a file of a plurality of, for example four (4), openings in the connector's insulator I on the holding bed 901 in positions in alignment with the axial direction of the coated wire CW held in the groove 815 (FIG. 13) in the terminal inserting means 80, and means 930 for laterally positioning in succession a line of a plurality of openings OP in the connector's insulator I at positions in alignment with the axis of the terminal T held in the terminal inserting means 80.

The holding bed 901 of the insulator I has a recess 902 into which the surface of the insulator provided with openings for receiving terminals is fitted so that the surface faces the terminal inserting means 80. The holding bed 901 is formed integrally with a downwardly extended leg 903 which is fitted in a vertical channel 922 provided in a support 921 of means 920 for positioning in vertical direction. The holding bed 901 is capable of descending positively by its own weight or by means of a spring 904 provided in between the holding bed 901 and the support 921.

Figure 16:
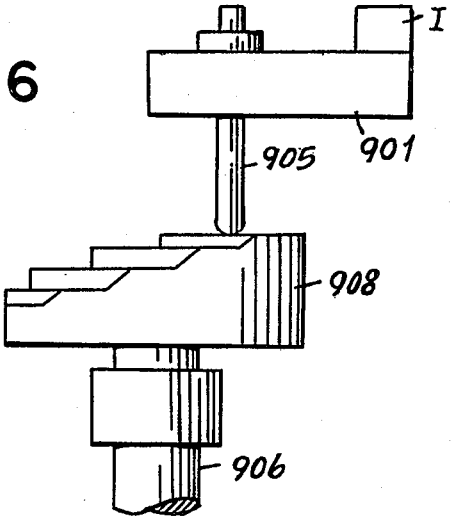
FIG. 16 is a schematic diagram showing the relationship between a bed for holding the insulator of the connector and a stepped disc.

The holding bed 901 also has a short shaft 905 of which lower end is abutted on the upper surface of a stepped disc 908 which is mounted to the support 921 by means of a shaft 906 which is in turn mounted through suitable means (not shown) so as to be turned at a predetermined angle at a time. The upper surface of the stepped disc 908 is formed with a stepped planes (see FIG. 16) which lifts the short shaft 905, therefore, the holding bed 921, axially, i.e. vertically by a desired path.

The support 921 is fixedly secured to a sliding plate 931 which is mounted to the frame 100 so as to be slidable in the direction parallel with the axis of the first driving shaft 12. This sliding plate 931 is pulled in the direction shown by an arrow 900A by any suitable means such as a weight 932 through a cord 933 extended over a pulley block 190 mounted to the frame 100. To the upper surface of the sliding plate 931, a plain ratchet member 934 extended in parallel with the axis of the first driving shaft 12 is mounted. The plain ratchet member 934 has series of teeth 935 and 936 on both sides. The pitch of the teeth series 935 and that of the series 36 are same but they are arranged out of alignment by ½ pitch to each other.

Pawls 937 and 938 are disposed respectively relative to the teeth series 935 and 936 of the plain ratchet member 934. These pawls are respectively engaged with or disengaged from the teeth series 935, 936 by the energization of an electromagnet 939 and the action of a spring 942 so as to move the sliding plate 931 in the direction shown by the arrow 900A by the weight 932. As described hereinbefore, since the pitches of the teeth series 935 and 936 of the plain ratchet 934 are equivalent but they are arranged out of alignment by ½ pitch to each other, when one of the pawls, for example, the pawl 937 is disengaged from the teeth 935 by the energization of the electromagnet 939, the other pawl 938 engages with the teeth series 936 being out of alignment by ½ pitch from the teeth series 935, thus the sliding plate 931 moves by ½ pitch in the direction of the arrow 900A, then when the electromagnet 939 is deenergized, the pawls 937 and 938 are actuated by a spring 942 whereby the pawl 937 is engaged with the teeth series 935 while the pawl 938 is disengaged from the teeth series 935. Therefore, every time the electromagnet 939 is energized, the sliding plate 931 moves in the direction shown by the arrow 900A by one pitch of the teeth series.

A handle 950 is provided in any suitable part of the sliding plate 930 or support 921 to retreat the sliding plate 930, therefore, the support and the holding bed 901 in the opposite direction of the arrow 900A.

Preferably a limit switch 951 is disposed directly under the weight 932 leaving a suitable space therebetween. The limit switch is connected to a circuit for actuating an alarm or an indicating lamp and arrangement is made such that when the sliding plate 931 moves a predetermined distance in the direction 900A, the weight 932 actuates the limit switch 951 whereby to indicate the close of work.

(Operation)

In operation of the automatic connector mounting apparatus of the present invention arranged as set forth hereinabove, the operator of the apparatus may be picked up one coated wire from a wire group consisting of a plurality of coated wires, the wire is brought into contact with the conical guiding member 212 in the gripping means 20, and the wire is inserted between the stationary cutting edge 301 and the movable cutting edge 302 in the wire cutting means. When the end of the wire is contacted with the the microswitch SW at the side while maintaining the wire in tensioned state, the one-turn clutch 11 is actuated consequently the coated wire is gripped in between the arm 205 and the block 215 in the gripping means 20 and it is cut by the cutting edges 301 and 302 spaced a predetermined length from the gripped position.

After the coated wire is stripped over a predetermined length from its cut end by the conductor exposing means 40 and an electric terminal T is pressed to the exposed conductor, the coated wire provided with the terminal is turned at 90 degrees and fed to the terminal inserting means 80 by the guiding means 70 to insert the terminal into an opening in the insulator I positioned by the insulator positioning means 90.

At this time, the operator picks up the next coated wire and after it is inserted in between the cutting edges 301 and 302 through the gripping means 20 as described hereinbefore, and when the microswitch SW is actuated by the coated wire, the steps of cutting the wire, exposing the conductor, pressing a terminal to the conductor and inserting the terminal into an opening in the insulator are repeated.

According to the present invention, since terminals can be respectively attached in succession to coated wires and mounted to the connector's insulator by merely inserting the free ends of coated wires into a predetermined portion of the apparatus of the present invention, a highly skilled operator is not required.

A preferred embodiment of the present invention has been illustrated and described in detail, however, it is understood that the invention is not limited only thereto but various modifications may be provided without departing from the spirit and the scope of the claims of the present invention.

We claim:

1. An apparatus for mounting a connector to coated wire, comprising means for gripping the free end side of the coated wire, means for cutting the free end part of said coated wire to a predetermined length, means for removing the coating of said coated wire to a predetermined length from the cut end thereof to expose the conductor, means for mounting an electric terminal to the exposed conductor, means for holding an insulator for the connector, means for guiding the terminal mounted to said coated wire to the front of the connector held by said holding means, and means for inserting said terminal into an opening provided in said insulator for the connector held by said holding means.

2. An apparatus as claimed in claim 1, wherein said coated wire is in the form of a bundle consisting of a plurality of coated wires and said connector is a multipolar connector having a plurality of openings.

3. An apparatus for mounting a connector to coated wire, comprising a motor, a clutch connected to the output shaft of said motor, a switch for actuating said clutch, an output shaft of said clutch, a second output shaft orthogonal to said output shaft, means for cutting the free end part of said coated wire to a predetermined length, means for removing the coating of said coated wire to a predetermined length from its cut end to expose the conductor, means for mounting an electric terminals to said exposed conductor, means for guiding the terminal to the front of means for holding an insulator for the connector, and means for inserting said terminal into an opening provided in said insulator for the connector held by said holding means.

4. An apparatus as claimed in claim 3, wherein said clutch is a one-turn clutch.

5. An apparatus as claimed in claim 3, wherein said coated wire gripping means and said guiding means are arranged to operate in association with a cam mounted to the second output shaft of said clutch.

6. An apparatus as claimed in claim 3, wherein said coated wire cutting means and said conductor exposing means are arranged to operate in association with a cam mounted to the first output shaft of said clutch.

7. An apparatus as claimed in claim 3, wherein said terminal inserting means is arranged to operate in association with the cams mounted respectively to said first and second output shafts of said clutch.

8. An apparatus as claimed in claim 3, wherein said connector holding means comprises a sliding plate for moving said connector holding means horizontally in parallel with said first output shaft and means for moving said connector holding means vertically relative to said sliding plate.

9. An apparatus as claimed in claim 8, wherein said means for moving said connector holding means horizontally comprises means fixedly secured to said sliding plate and having ratchet teeth lines, latch means to be actuated by an electromagnet, and weighted pulling means.

10. An apparatus as claimed in claim 8, wherein said means for moving said connector holding means vertically relative to said sliding plate includes a stepped disc.

* * * * *